United States Patent [19]

De Angelis et al.

[11] Patent Number: 4,814,567

[45] Date of Patent: Mar. 21, 1989

[54] ELECTRO-THERMIC RESONANCE SYSTEM FOR HEATING LIQUID

[75] Inventors: Pedro C. De Angelis; Nedo D. L. Dragicevic, both of Cochabamba, Bolivia

[73] Assignee: Darko Jorge Lazaneo Dragicevic, Cochabamba, Bolivia

[21] Appl. No.: 884,809

[22] Filed: Jul. 11, 1986

[51] Int. Cl.[4] ..... H05B 6/62

[52] U.S. Cl. ..... 219/10.51; 219/10.41; 219/10.65; 219/10.75; 219/10.81

[58] Field of Search ..... 219/10.41, 10.43, 10.51, 219/10.49 R, 10.65, 10.81, 10.75, 10.77, 10.55 R, 10.47, 10.491

[56] References Cited

U.S. PATENT DOCUMENTS

| | | | |
|---|---|---|---|
| 1,572,873 | 2/1926 | Allcutt | 219/10.81 |
| 2,494,716 | 1/1950 | McMatton et al. | 219/10.81 X |
| 2,747,068 | 5/1956 | Lackner | 219/10.75 |
| 2,788,426 | 4/1957 | Thompson | 219/10.75 |
| 2,838,640 | 6/1958 | Mann et al. | 219/10.65 X |
| 3,532,848 | 10/1970 | Loring, Jr. et al. | 219/10.81 X |
| 4,028,518 | 6/1977 | Boudouris et al. | 219/10.81 |
| 4,119,826 | 10/1978 | Chambley et al. | 219/10.81 |

*Primary Examiner*—Philip H. Leung
*Attorney, Agent, or Firm*—Millen & White

[57] ABSTRACT

A liquid, such as water, is heated by the application of alternating electric current to resonate the molecules of the liquid. In a preferred embodiment, multi-phase alternating current is applied with one phase applied to a pair of capacitive elements inserted into the liquid and the other phase applied to an inductive element inserted in the liquid between the pair of capacitive elements. By applying alternating current to the liquid in such a manner, the liquid is rapidly and efficiently heated.

17 Claims, 3 Drawing Sheets

ELECTRO-THERMIC RESONANCE SYSTEM FOR HEATING LIQUID

BACKGROUND OF THE INVENTION (1) Field of the Invention

The instant invention relates to an electro-thermic resonance system, and more particularly, the instant invention relates to methods of an apparatus for heating liquids.

(2) Technical Considerations and Prior Art

There are literally thousands of types of devices for heating liquid by utilizing electricity. For example, it is necessary to heat water for cooking, space heating, bathing, washing fabrics and dishes, commercial utilization and for general utility in industrial, commercial, household and recreational uses. Currently, liquids, such as water, are heated by energizing immersed electrical resistances in the water, by conducting current through the water and to a lesser degree, by utilizing compressible refrigerants. While there are various advantages and disadvantages to each of these approaches, a common disadvantage is relatively low efficiency. Accordingly, there is a need for a more efficient system for heating liquids, such as water.

SUMMARY OF THE INVENTION

It is an object of the instant invention to provide a system which heats liquid by the resonance between the oscillations of alternating electrical current and thermic oscillation of molecules of the liquid. The efficiency of the resonance is improved as the liquid heats up.

This object is accomplished by applying alternating current to metallic plates immersed in the liquid in spaced relation to one another. In accordance with a preferred embodiment of the invention, more than one phase of a two-phase alternating current supply is utilized with one phase being connected to pairs of outer plates to in effect form a capacitance of the extremes of the electrical waves and with the other phase being connected to a plate, more efficient having the shape of a spiral, between the first plate so as to act as an inductance. The inductive plate shaped as a spiral may also act as a resistive element.

The aforesetforth arrangement does not work with direct current because in essence the invention functions by transforming electrical oscillation into molecular oscillation.

Upon further study of the specification and appended claims, further claims and advantages of this invention will become apparent to those skilled in the art.

As for reference of the phenomenon explained we will use the expression "thermo-tronics".

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

DESCRIPTION OF THE PREFERRED EMBODIMENTS

Figure 1:
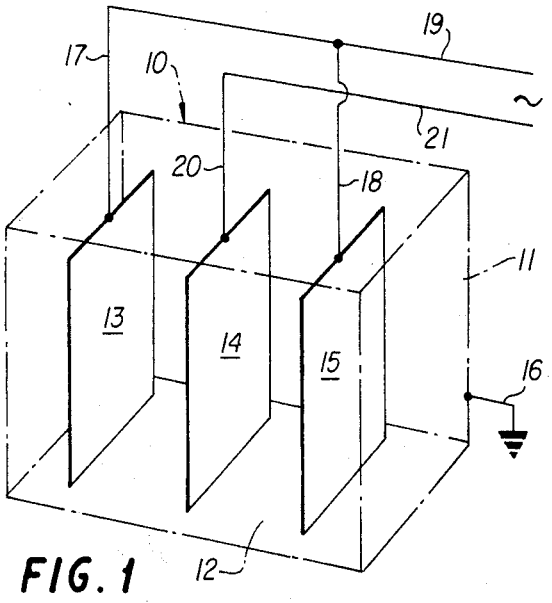
FIG. 1 is a perspective view of a basic cell unit using three metallic plates.

Referring now to FIG. 1, there as shown a basic cell unit, designated generally by the numeral 10, incorporating the primary features of the instant invention, wherein a container 11 has a liquid therein, such as water 12, and three metallic plates or elements 13, 14 and 15. The container 11 is preferably of metallic material, but may in the alternative have a conductor (not shown) either completely or partially lining the interior of the container. In either case, either the container 11 or the conductive lining is preferably connected to ground by a line 16. The plates 13 and 15 are connected by lines 17 and 18 to one phase 19 of a two-phase alternating input current, whereas plate 14 is connected by line 20 to line 21 to which is applied the other phase of a two-phase alternating current. The metallic plate 14 serves as an instananeous inductive plate, whereas the metallic plates 13 and 15 which are positioned on opposite sides of the plate 14 serve as an instantaneous capacitive plates. The plates are preferably approximately 8 cm wide and 10 cm long. Preferably the plates are spaced 6 mm apart at the bottom and taper from 1 mm to 3 mm thickness at the top.

The liquid 12 to be heated by the system may use distilled water, tap water, or any other liquid that is substantially non-conducting. Preferably, the plates have highly polished surfaces and are made of any type of metallic material such as cooper, tin plate or stainless steel. Upon energizing the line 19 one phase and line 21 with the other phase of a two-phase alternating current the liquid 12 becomes excited and rapidly boils. In accordance with applicants' experiments, fifty hertz alternating current is applied to the lines 19 and 21 and tap water is used as the liquid 12. By utilizing the aforedescribed apparatus, thermal agitation of the molecules increases exponentially with respect to time. The plates 13, 14 and 15 have to be isolated from each other and contained by a none-conductive material. It is been found that the apparatus 10 sterilizes water simultaneously while heating it by both heating and by the effects of the electrical wave on the microorganisms in the water.

Figure 2:
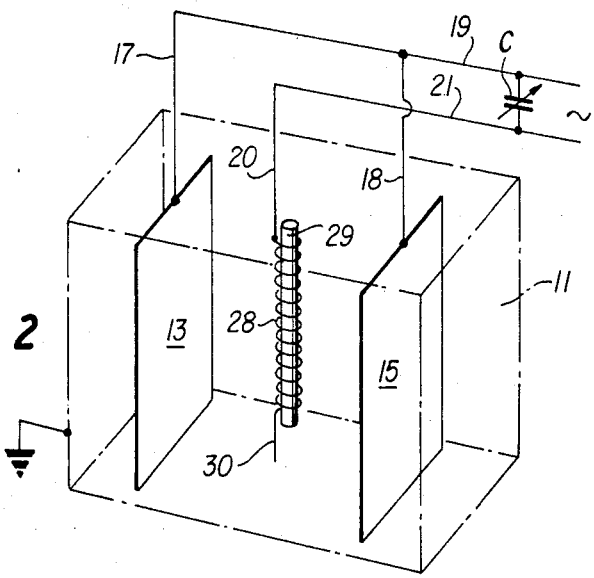
FIG. 2 is a perspective view of a basic cell unit using two external plates and one central spiral element with one end free and floating.

Referring now to FIG. 2 where there is shown another embodiment of the invention, it is seen that the instantaneous inductive element 14 of FIG. 1 has been replaced by a coil 28 arranged in a spiral about a non-conductive core 29. The end 30 of the coil 28 is allowed to float free in the liquid 12 without touching either the grounded container 11 or both capacitor plates 13 and 15. But can touch only one plate, without impairing system. As previously explained, it improves the efficiency of the system if the plates 13 and 15 have highly polished surfaces and if the thin wire utilized in the coil 28 has a highly polished surface. As previously explained, if the plates 13 and 15 are moved into close proximity with the inductive coil 28 efficiency is again enhanced. In FIG. 2 an external variable capacitor "C" is connected across lines 19 and 21.

Figure 3:
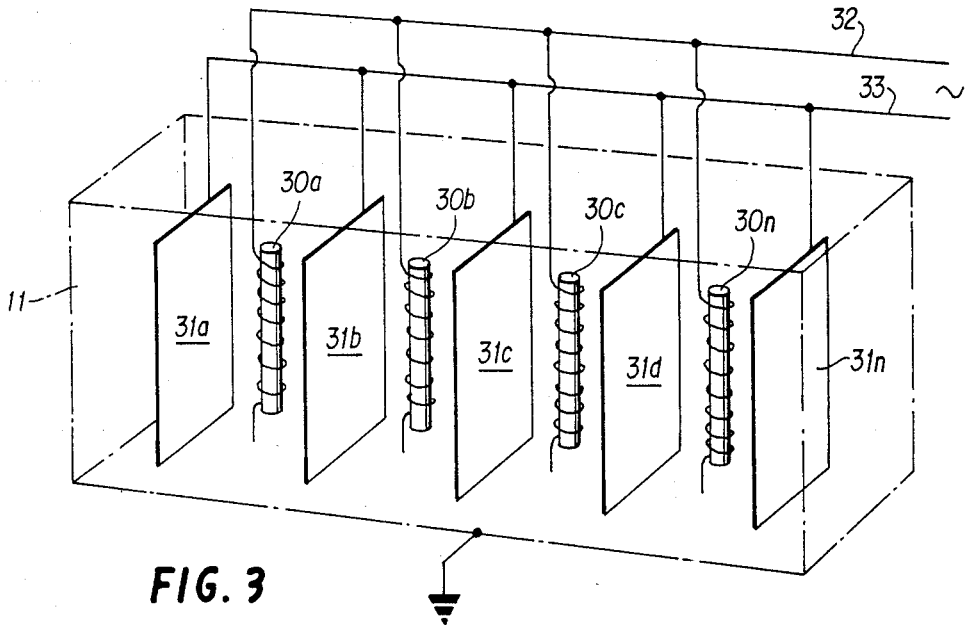
FIG. 3 is a perspective view showing a plurality of plates connected in series.

Referring now to FIG. 3, there is shown an arrangement with several units in series wherein there are a plurality of inductive members 30*a*–30*n* and a plurality of capacitance elements 31*a*–31*n*. As with the arrangements of FIGS. 1 and 2, the inductive plates 30*a*–30*n* are each connected to one phase of the two-phase alternating current input by a line 32, while the capacitance plates 31*a*–31*n* are each connected to the other phase of the two-phase alternating current input by line 33. The inductive elements 30*a*–30*n* and capacitance elements 31*a*–31*n* are shown in in FIG. 3, however it is within the scope of this invention to connect the elements in series (not shown). All elements have to be separated by a non-conductive material. If desired each plate can have its own switch.

It has been found that the system will work with only one phase of alternating current connected either to the central plate 14 or to the side plates 13 and 15, however it is essential that the container 11 be grounded if the single phase system is to function.

The capacitance plates can have various geometrical shapes and forms, i.e., the plates can be rectangular, conical, square, triangular, cylindrical or have various shapes such as a U-shape, T-shape, L-shape, E-shape, C-shape, etc. Moreover, the capacitance plates may have holes or perforations, or may be made of metallic networks, nets, grills or meshes in order to improve fluid circulation and efficiency of the system.

The inductance elements may also have different forms, i.e., the elements may be flat, helical, zig-zagged sinusoidal, or may have rectangular, circular or cylindrical forms. Some forms may be more efficient than others.

Figure 5:
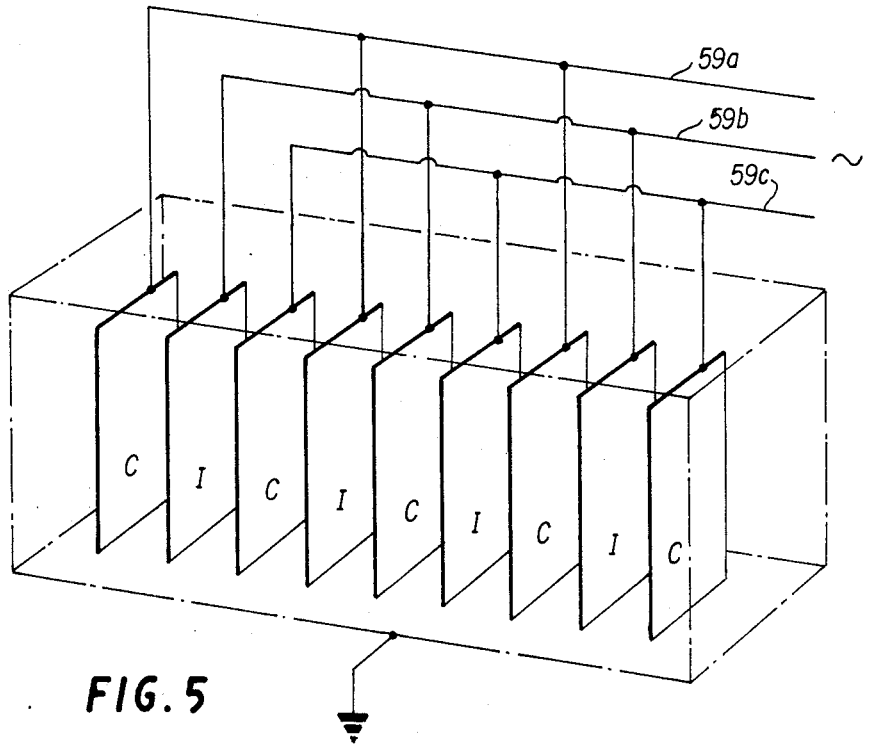
FIG. 5 is a perspective view showing an apparatus using three phases alternating current.

If is desired to utilize multi-phase alternating currents having more than two phases, one need simply to connect one phase to one plate as is shown in FIG. 5 and so on in order to render the system operational in accordance with the principles of the instant invention.

The system can be configured on a large or small scale and will operate in a confined environment of high or low pressure or in an open environment at atmospheric pressure. Very cold temperatures slow down the system but do not impair it. When used as a heater to heat a flowing stream of water, such as a stream of water through a pipe, cool water tends to slow down heating in the system so that, if desired, cool water can enter the system and leave the system in a heated but not boiling state.

Figure 4:
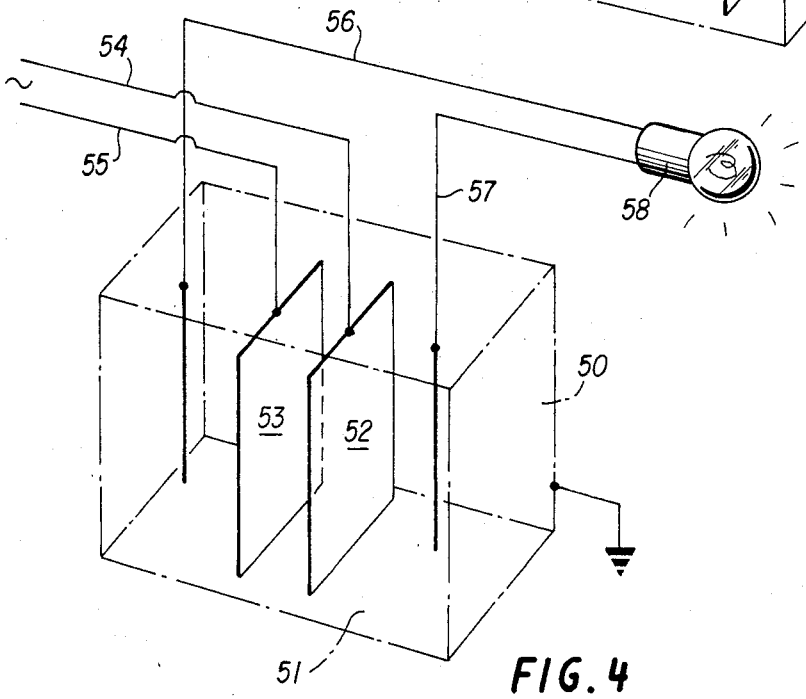
FIG. 4 is a view showing apparatus used in an experimental configured to demonstrate the "thermotronic wave phenomenon" which results from electro-thermic resonance.

Referring now to FIG. 4, wherein the inventors have configured the experiment to explain the thermo-tronic standing wave it is seen that there is a container 50 which is filled with water 51 into which are inserted two plates 52 and 53. The plate 52 is connected to the one phase of two-phase alternating current by line 54 and plate 53 is connected to the other phase of the alternating current by line 55. The plates are placed from 0.5 to 1.0 cm apart. Also inserted into the liquid 51 are leads 56 and 57 from fifteen to twenty-five watt lamp 58. The alternating current, if utilized in the experiment is fifty cycles, 220 volt two phase alternating house current. The leads 56 and 57 are spaced 2 to 4 cm from the plates 53 and 52, respectively, and have approximately 8 cm of stripped wire immersed in the liquid 51.

Preferably the sizes of plates 52 and 53 are approximately 10 by 8 cm with each plate being 1 to 2 mm. thick. The plastic container 50 containing the plates is approximately 15 to 20 cm in depth and 15 cm in length. In conducting the experiment, the two plates 52 and 53 are set in the middle of the plastic container 50. Upon turning on the alternating current, the lamp 58 glows at a very low level. As the water increases in temperature, the glow of the lamp 58 increases to a elevated level which is reached when the water reaches a steady boiling state at which time the brightness of the glow remains constant at the elevated level. This increase in brightness of the lamp occurs due to the "thermo-tronic standing wave" in that as the temperature of system increases, the thermo-tronic efficiency increases transport of electrical energy in the water 51. Then the resonance is between the electric oscillation of the alternating current and the oscillation of the molecules of water. It was also found that the thermo-tronic standing wave can have inverse properties, by which it can transform mechanical oscillation into electrical oscillation by other methods and apparatus.

Figure 6:
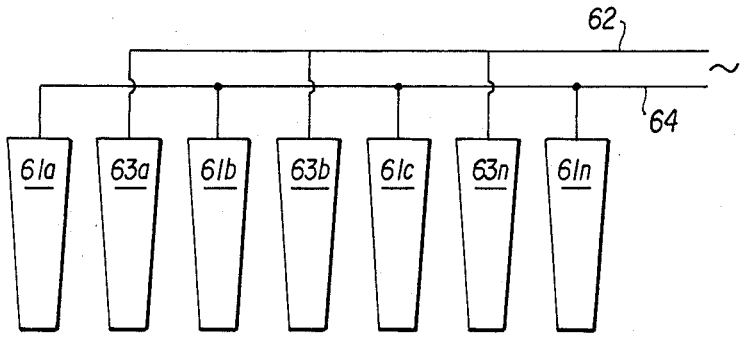
FIG. 6 is a side view illustrating as alternative embodiment of the invention wherein the elements are wedge shaped and arranged in parallel.
Figure 7:
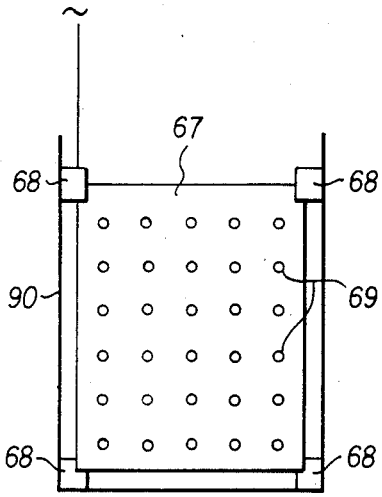
FIG. 7 is a perspective view of a single wedge shaped plate which is perforated and which has supporting brackets of non-conductive material.
Figure 8:
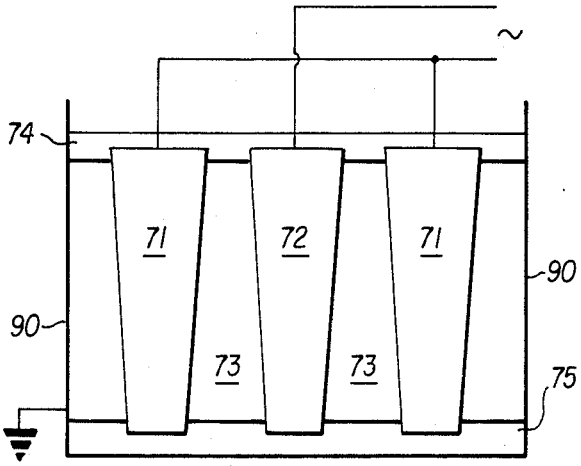
FIG. 8 is a side view of another embodiment of the invention wherein the wedge shaped elements are closer together at the top than the bottom.
Figure 9:
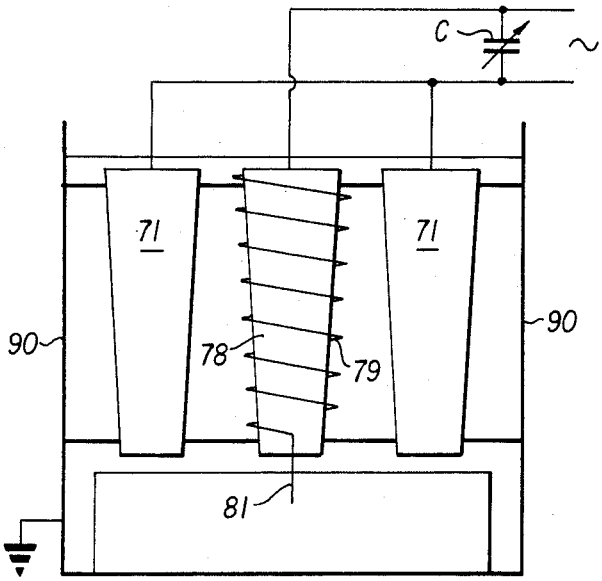
FIG. 9 is a side view of another embodiment of the invention wherein the outboard elements are wedge-shaped capacitive device and the in board element is a helical inductive device.
Figure 10:
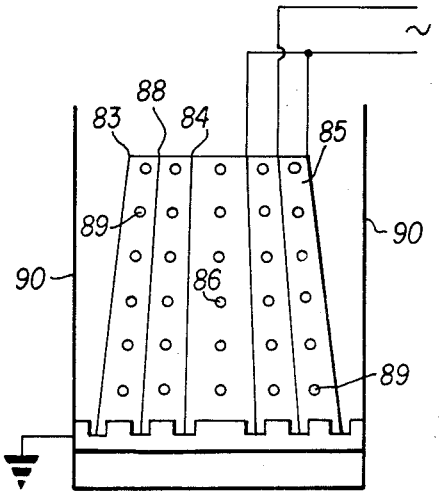
FIG. 10 is a perspective view of another embodiment of the invention utilizing a plurality of hollow, coaxial conical elements.

Referring now to FIGS. 5–10 there are shown various other embodiments and arrangements that the plates or elements of the instant invention may assume and be more efficient. In FIG. 5 capacitive and inductive elements C and I respectively are arranged in an alternating array with three-phase electrical current applied over links 59*a*, 59*b* and 59*c* to subarrays of three plates with an inductive plate I between a pair of capacitive plates C. In FIG. 6, the elements 61*a*–61*n* are connected to a first phase line 62 while the elements 63*a*–63*n* L are connected to a second phase line 64. Each of the elements 61 and 63 are wedge-shaped and are triangular in cross section. In FIG. 7, a single element 67 is shown which is supported by non-conducting brackets 68 and is perforated by a multiplicity of holes 69. In FIG. 8, an arrangement is shown wherein the outer capacitive type elements 71 are wedge-shaped so as to be closer together at the top thereof while the inductive element 72 is also wedge-shaped so that the space 73 between the inductive element 72 and the capacitive element 71 converges in the upward direction. The element 71 and 72 are retained in place by upper and lower retainers 74 and 75, respectively made of a non-conducting material. In FIG. 9, the capacitive elements 71 are similar to the capacitive element 71 of FIG. 8, however the inductive element 78 is configured as a helical wire 79 having its free end 81 floating free in the liquid. An external variable capacitor "C" is connected across phases of alternating current. In FIG. 10, the capacitive elements 83 and 84 are conical with perforations 85 and 86, respectively, therein. The inductive element 88 is disposed between the capacitive elements 83 and 84 and is conical with perforations 89 therein. In each of the FIGS. 6, 8, 9 and 10 the elements are contained within a grounded container 90. Generally the wedge-shaped plates shown in FIG. 6–9 have a dimension of 8 cm. by 10 cm. The bottom separations between plates members is approximately 5 mm. while the top separation is 3 to 4 mm.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Apparatus for efficiently heating a liquid comprised of molecules, the apparatus comprising:

a liquid;

a container containing the liquid;

a source of multi-phase alternative current;

at least one pair of first metallic elements within the container and immersed in the liquid;

at least one second element disposed between the pair of metallic elements and immersed in the liquid;

means connecting the pair of first elements to one phase of the source of multi-phase alternating current, and means connecting the second element to another phase of the source of alternating current, wherein upon application of the multiphase alternating current, liquid in the container is rapidly heated by resonance of the molecules in the liquid.

2. The apparatus of claim 1 wherein the container is made of a conducting material and is grounded.

3. The apparatus of claim 1 wherein the container is made of a non-conducting material and includes conducting means therein, which conducting means is grounded.

4. The apparatus of claim 1 wherein the metallic element disposed between the pair of elements is configured as a coil of wire having a free end floating in the liquid.

5. The apparatus of claim 4 wherein the liquid is water.

6. The apparatus of claim 1 wherein the liquid is water.

7. The apparatus of claim 1 wherein there are a plurality of said pairs of first metallic elements connected to said one phase of the source multi-phase alternating current and plurality of said single second elements disposed between each of said pairs of first metallic elements connected to said other phase of the source of multi-phase alternating current.

8. The apparatus of claim 7 whereinb the plurality of pairs of first and second elements are connected in series.

9. The apparatus of claim 7 wherein the plurality of pairs of first and second elements are connected in parallel.

10. The apparatus of claim 7 wherein each element has a switch means associated therewith so as to control the level of electrical energy, rate of heating and temperature level of the liquid.

11. A method of heating a liquid comprised of molecules, the method comprising the steps of:

applying multi-phase alternating current through the liquid via a circuit including capacitive elements immersed in the liquid and inductive elements immersed in the liquid between the capacitive elements by applying one phase of the current to the capacitive element and another phase of the current to the inductive element while maintaining the capacitive reactance of the circuit equal to the inductive reactance.

12. The method of claim 11 wherein the liquid is water and the current is fifty cycle, 220 volts, two phase alternating current.

13. The method of claim 11 further including the step of selecting a distance between the elements to maximize the efficiency of the resonance.

14. The method of claim 13 wherein the liquid is water and the current 220-volts two-phase current of about fifty cycles.

15. The method of claim 11 wherein the liquid is contained in a container and further including the steps of grounding the container.

16. The method of claim 11 wherein a capacitor positioned in the circuit at a location external to the liquid is connected across lines supplying the alternating current.

17. The method of claim 16 wherein the external capacitor is variable.

* * * * *